US005148890A

United States Patent [19]

Sipe

[11] Patent Number: 5,148,890

[45] Date of Patent: Sep. 22, 1992

[54] PORTABLE UTILITY PLATFORM UNIT

[76] Inventor: Linus A. Sipe, 366 N. Walnut, Dallastown, Pa. 17313

[21] Appl. No.: 743,987

[22] Filed: Aug. 12, 1991

[51] Int. Cl.[5] ..... E04G 1/36

[52] U.S. Cl. ..... 182/45; 182/222; 248/237; 52/749

[58] Field of Search ..... 52/696, 699, 747, 650, 52/749; 248/236, 237, 343; 182/45, 119, 128, 222; 269/910

[56] References Cited

U.S. PATENT DOCUMENTS

| | | | |
|---|---|---|---|
| D. 318,785 | 8/1991 | Dean | 52/696 |
| 815,254 | 3/1906 | Barnes et al. . | |
| 2,964,807 | 12/1960 | Kennedy | 52/696 |
| 3,010,162 | 11/1961 | Klein | 52/696 |
| 3,778,952 | 12/1973 | Soucy | 52/696 |
| 4,048,924 | 9/1977 | Wibben . | |
| 4,068,446 | 1/1978 | Brueske . | |
| 4,121,690 | 10/1978 | Rawlings et al. | 182/45 |
| 4,490,956 | 1/1985 | Palacio et al. | 52/696 |
| 4,646,877 | 3/1987 | Whan . | |
| 4,689,927 | 9/1987 | Green et al. | 182/45 |

FOREIGN PATENT DOCUMENTS

| | | | |
|---|---|---|---|
| 2485598 | 12/1981 | France | 182/222 |
| 1352697 | 5/1974 | United Kingdom | 182/222 |

*Primary Examiner*—David A. Scherbel
*Assistant Examiner*—Christopher T. Kent
*Attorney, Agent, or Firm*—Samuel M. Learned, Jr.

[57] ABSTRACT

A portable utility platform unit adapted to be employed in combination with other such units to cooperatively provide a temporary support surface upon roof trusses or floor joists for workers in the building trades.

10 Claims, 2 Drawing Sheets

"T"
"d"
10
12
18
20
22
24
26
28
30
32
34
35
36
3
4
5

PORTABLE UTILITY PLATFORM UNIT

BACKGROUND OF THE INVENTION

The present invention relates to a worker support apparatus for use in enhancing the safety and convenience of building trades construction workers when installing either roof trusses or floor joists, or the panels or sheeting that is applied respectively thereto, and consists of a portable utility platform unit which is detachably installed in a mechanically cooperative multiple combination with other such units upon the trusses or joists, to be sequentially removed therefrom and leap-frog re-installed by a worker as the job progresses.

At the present time, adequate and convenient support means for truss and joist workers on small and medium sized building construction projects are either non-existent or at best consist of make-shift arrangements comprised of stringers temporarily nailed across trusses or joists to provide some stabilization and support.

Among the prior art teachings which show purlin and truss support apparatus for workers and materials are those as respectively set forth in U.S. Pat. No. 4,048,924 to Wibben dated Sep. 20, 1977, for an elongated skeletal frame mounted to span a plurality of pitched roof purlins and provide a roofing panel carrier and support structure; U.S. Pat. No. 4,646,877 to Whan dated Mar. 3, 1987, for a wheeled purlin spanning worker and material support scaffolding adapted for use in major building structure projects; and U.S. Pat. No. 4,068,446 to Brueske dated Jan. 17, 1978, for a large scale wheeled and motorized purlin spanning worker and material support scaffolding also for use in major building structure projects.

With respect to prior art disclosures which show certain similarities of structural aspects with regard to applicant's support apparatus, the teaching by Barnes et al in U.S. Pat. No. 815,254 dated Mar. 13, 1906, is for a portable hoisting tackle device that is adapted to be placed upon either gabled or flat roofs. Functionally, the truss spacing and stabilizing tool shown in a brochure titled "Truslock Spacing Tools" by TRUSLOCK, Inc., of Calvert City, Ky., teaches a portable apparatus for engagably spacing and stabilizing both trusses and joists during erection or installation, but does not per se functionally provide either a worker or material support surface.

The applicant herein by his invention provides an efficient and novel apparatus and method for newly overcoming the long existing problem of truss and joist workers not having a safe and convenient means for personal, material and equipment support when involved in the activities of roof truss erection and paneling, and floor joist installation and sheeting.

SUMMARY OF THE INVENTION

It is the principal object of the present invention to provide a portable utility platform unit that may be employed in a safe and efficient manner by workmen as a support surface when installing roof trusses and panels as well as floor joists and sheeting.

It is another object of the present invention to provide a portable utility platform unit that is detachably assembled to roof trusses and floor joists in such a manner so as to also provide both truss and joist spacer and stabilizing means while at the same time serving as a workman support surface.

It is also an object of the present invention to provide a portable utility platform unit that is light and easily handled and controlled by workmen in the placement, movement, and utilization thereof.

Still another object of the present invention is to provide a portable utility platform unit that is of a unitized construction and thereby adapted for quick, safe and easy placement and removal by workmen for mechanically cooperative repositioning placement with other such units upon roof trusses and floor joists in extending both the use options and functional utility thereof.

A further object of the present invention is to provide a portable utility platform unit that enhances workmen efficiency and productivity by enabling them to work in a reduced hazard circumstance with improved safety and convenience.

Yet another object of the present invention is to provide a portable utility platform unit that is dimensionally profiled to be used upon roof trusses either pitched or flat, or upon floor joists, which have a standard 24-inch center-to-center spacing, or alternately a 16-inch center-to-center spacing.

An additional object of the present invention is to provide a portable utility platform unit that can be installed and removed or relocated in establishing a truss or joist worker support surface with a greater speed and facility than is presently available with any other devices and methods known to be in current use.

The foregoing, and other objects hereof, will be readily evident upon a study of the following specification and accompanying drawings comprising a part thereof.

DETAILED DESCRIPTION OF THE INVENTION

Figure 1:
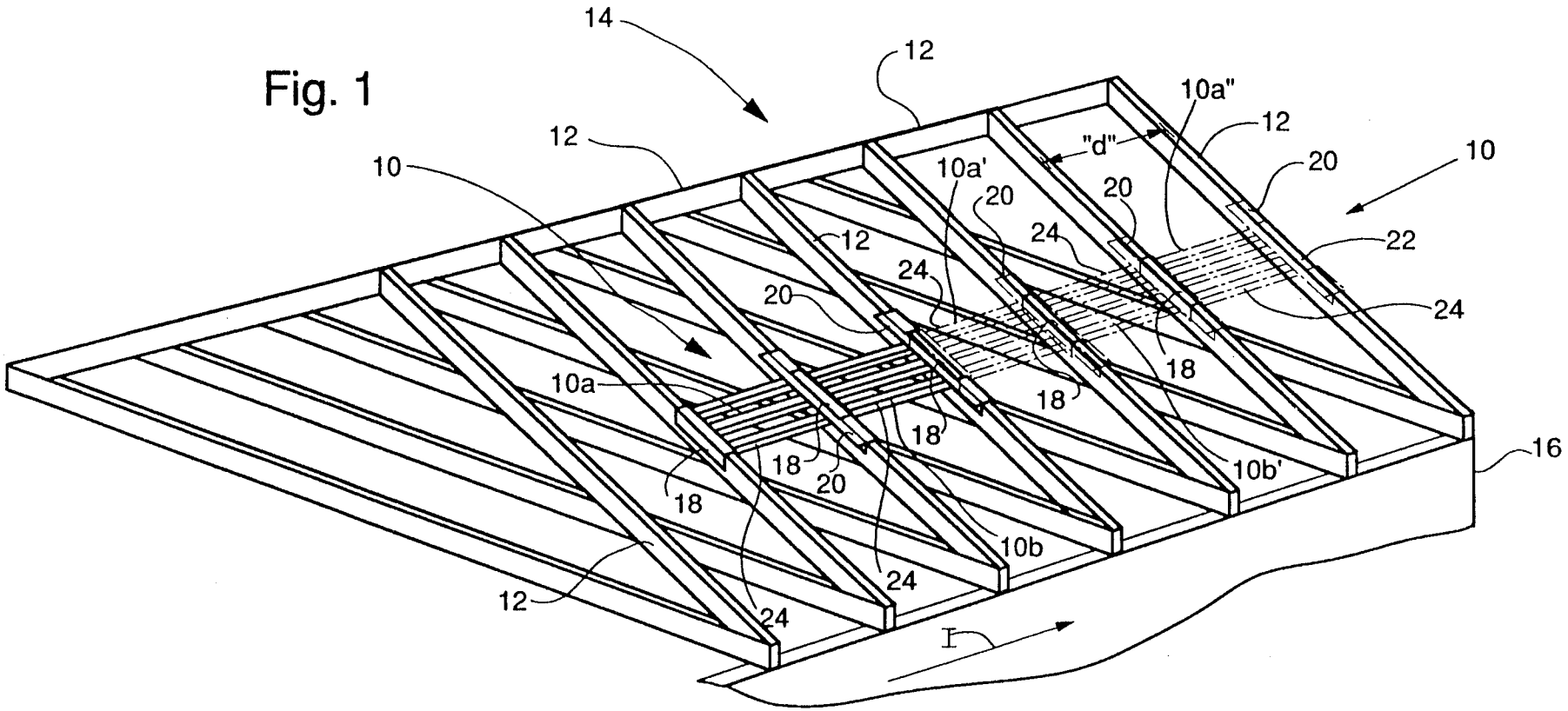
FIG. 1 is a perspective elevation view of an exemplary truss profile comprising a typical gabled roof construction, illustrating thereon the manner of use employment of the portable utility platform unit comprising the present invention.

Referring to FIG. 1, two of the portable utility platform units 10 of present invention, and the major component parts thereof comprising the same, are shown in a perspective elevation view operationally assembled in mechanically cooperative combination one with the other upon exemplary trusses 12 profiled in a typical gabled roof construction 14 of a conventional building structure 16, wherein those illustrations of said unit 10 shown in phantom line rendition indicate forwardly displaced relocation positions for said units 10 as the same would appear when moved forward by a worker as the job of truss 12 erection and installation progressed. The units 10 are constituted of three major structurally cooperative elements, the first two such structural elements being a depending short truss clamp member 18 and a depending elongated truss clamp member 20 which has provided therein a recessed cut-out 22 adapted to conformably receive in mechanically cooperative assembly combination therewith the short truss clamp member 18 of another such unit 10 to thereby provide an extended worker and material support surface by employing a mechanically cooperative plurality of units 10 as is illustrated in FIG. 1. The spaced set of depending truss clamps 18 and 20 are rigidly joined and retained in an aligned and parallel center-to-center disposition distance "d" one with respect to the other by the third major structural element, being a plurality of perpendicularly affixed respectively parallel and equally spaced treadle members 24, which for purposes of illustration and discussion herein is a number of three being a number to be considered as exemplary only and not limiting. Likewise, the parallel spaced disposition distance "d" is determined by the center-to-center spacing of the trusses 12, and in standard building trades construction practices may be either a 24-inch center-to-center spacing or a 16-inch center-to-center spacing, or any other spacing distance that is appropriate and suitable to the particular specifications of the job at hand, and is not to be considered as limiting.

Referring again to FIG. 1 to explain the preferred manner of use employment of the portable utility platform units 10 upon the trusses 12 of a typical gabled roof construction 16, wherein the two units 10*a* and 10*b* for purposes of exemplary illustration and discussion herein represent the use of two such units 10 employed in mechanically cooperative assembly combination by a workman to provide a stable support surface for himself and tools and materials when engaged in the positioning and installation erection of trusses 12 on the particular exemplary job of instant illustrative discussion. At the time of instant discussion consideration, the positioning and installation erection of trusses 12 is progressing from left to right as one views the illustration of FIG. 1, as indicated by the direction of the arrow "I", and the work to be performed at the unit 10*a* and 10*b* support position has been completed and is ready to progress forward as indicated by the direction of arrow "I". Supporting himself on unit 10*b*, the workman lifts unit 10*a* from its position upon the trusses 12 removing the same from mechanically interlocked combination with unit 10*b* and leap-frog repositions the removed unit 10*a* upon forward trusses 12 in a mechanically interlocked combination with unit 10*b* as shown in phantom at the unit 10*a'* position. Thus, as the job progresses a workman, by a successive leap-frog mechanically interlocked repositioning of the unit 10*b* to the unit 10*b'* position while being supported upon unit 10*a'*, and thereafter repositioning unit 10*a'* to the unit 10*a''* position in a like manner while being supported upon unit 10*b*, extends the use employment utility of said portable platform units 10 while at the same time stabilizing the particular trusses to which they are operationally installed at the specified center-to-center spacing distance while truss 12 positioning and installation erection procedures proceed forward to completion.

The portable utility platform units 10 as shown and illustrated in FIG. 1, and certain subsequent Figures hereinafter, may be fabricated or cast or molded from various metals and alloys thereof, or plastics, or combinations of metals and metal alloys and plastics by those methods and techniques well known to those skilled in such arts and commonly employed in such operations.

Figures 2, 3, 4, 5:
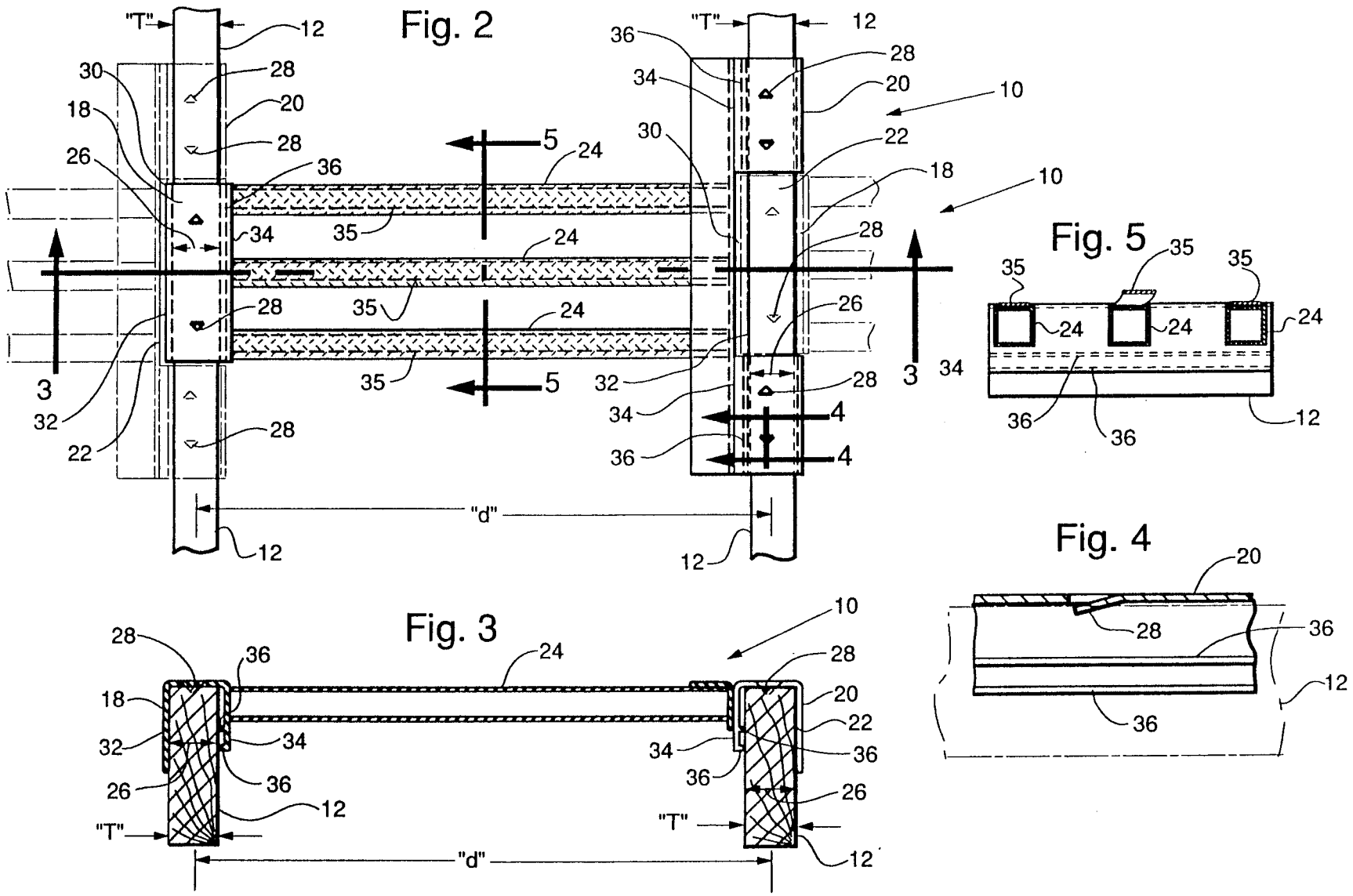
FIG. 2 is a top plan view of a portable utility platform unit comprising the present invention, being shown in operational use placement upon a spaced set of exemplary truss members, and in mechanically cooperative combination with two such other units which are adjacently shown in phantom in partial top plan view.
FIG. 3 is a sectional view of the portable utility platform unit as shown in FIG. 2 and seen along the line 3—3 thereof.
FIG. 4 is an enlarged sectional detail of a truss-locking spur as shown in FIG. 2 and seen along the line 4—4 thereof.
FIG. 5 is an end sectional view of the treadle members of the portable utility platform unit as shown in FIG. 2 and seen along the line 5—5 thereof, illustrating therein the alternate use of anti-skid friction tape rather than knurling to increase the frictional properties of the worker support surface.

Referring now to the enlarged top plan view of the portable utility platform unit 10 as illustrated in FIG. 2, wherein is shown more clearly the specific structural features thereof in addition to the mechanically cooperative employment thereof with other such units 10, and the manner of assembling the same to trusses 12 so they are thereafter easily removed for successive relocation use thereof but placed and positioned in such a manner as to provide a safe and secure portable support surface.

First, with regard to more specific structural detail of the unit 10 assembly. Each of the depending truss clamp members 18 and 20 are laterally sized so that the respective clamp openings 26 thereof fit in close slidable mechanical conformity to the 2-inch nominal thickness dimension "T" of a standard 2 by 4-inch, 2 by 6-inch, 2 by 8-inch, 2 by 10-inch, or 2 by 12-inch truss or joist, at the center-to-center specified spaced dimension "d" therebetween, so that there is no tendency for the units 10 to "wobble-work" their way down the inclined truss surfaces once they are operationally positioned thereon. Further, to prevent "straight slippage" of units 10 down the inclined truss surfaces after their operational positioning thereon, the respective depending truss clamp members 18 and 20 of the units 10 are also provided with a spaced plurality of truss-locking spurs 28 which are profiled to dig into the upper truss surface and thereby function as slippage prevention cleats as is more clearly shown in FIGS. 3 and 4.

Another structural feature of the units 10 shown in FIG. 2 is the provision of a flange slot 30 at the inside end of the recessed cut-out 22, to thereby allow for insertion therein of the outside depending flange 32 of the depending short truss clamp member 18 when units 10 are employed in mechanically cooperative combination assembly one with the other in providing an extended support surface as also shown in phantom in FIG. 2.

Further shown in FIG. 2 is the provision of an anti-skid grid surface 34 on the upper support side of the treadle members 24, showing in dashed line rendition the alternate provision of anti-skid tape 35 being applied thereto, both as a safety enhancement factor by increasing the frictional characteristics of the support surface to thereby reduce slipping hazards.

Considering now the side sectional view shown in FIG. 3, which illustrates additional structural detail as well as use and operational installation features of a portable utility platform unit 10, particularly the close slidable mechanical conformity fit of the respective depending truss clamp members 18 and 20 to the exemplary trusses 12. As also shown, each of the inside depending flanges 34 of the respective truss clamp members 18 and 20 are provided with a parallel longitudinally running spaced set of friction cleats 36 which tend to flex-engage and compressively dig into the sides of the trusses 12 when a load is supported by the treadle members 24, thereby further enhancing the safety and security of a unit 10 as a portable utility platform when in use.

The view shown in FIG. 4 is an enlarged sectional detail illustrating how the truss-locking spur 28 imbeds in the truss 12 to resist any tendency of an operationally installed portable utility platform unit 10 to slide down the sloping pitch of a gable roof truss, and thereby effectually maintains an operationally installed unit 10 in its placed and proper position during the use employment thereof.

Lastly, the view shown in FIG. 5 illustrates the alternative use of anti-skid tape 35 as a friction enhancing alternative to an anti skid grid surface for the upper support side of the treadle members 24.

Although the portable utility platform unit invention hereof, the structural characteristics and method of employment thereof, respectively have been shown and described in what is conceived to be the most practical and preferred embodiment, it is recognized that departures may be made therefrom within the scope of the invention, which is not to be limited per se to those specific details as described herein but is to be accorded the full scope of the claims so as to embrace any and all equivalent such devices, apparatus, and methods.

I claim:

1. A portable utility platform unit adapted to be detachably installed upon roof trusses between the spans thereof for supporting workmen during truss erection and installation procedures, said unit comprising in combination a short depending spaced flange truss clamp member, an elongated depending spaced flange truss clamp member provided with a recessed cut-out centrally intermediate the longitudinal ends thereof to form a slot adapted to conformably receive cooperatively therewithin the short depending spaced flange truss clamp member of another portable utility platform unit, and a plurality of laterally spaced treadle members parallelly assembling said short depending spaced flange truss clamp member to said elongated depending spaced flange truss clamp member thereby connectably joining the same at a clamp-to-clamp and center-to-center spacing equal to the specified truss-to-truss center-to-center spacing.

2. A portable utility platform unit according to claim 1 wherein said plurality of laterally spaced treadle members is three.

3. A portable utility platform unit according to claim 2 wherein the upper load bearing surfaces of said treadle members are provided with an anti-skid grid finish.

4. A portable utility platform unit according to claim 2 wherein the upper load bearing surfaces of said treadle members are provided with an anti-skid tape covering.

5. A portable utility platform unit according to claim 1 wherein the interior upper load bearing truss contact surface of said short depending spaced flange truss clamp member is provided with a set of truss-locking spurs.

6. A portable utility platform unit according to claim 1 wherein the interior upper load bearing truss contact surfaces of said elongated depending spaced flange truss clamp members are respectively provided with a set of truss-locking spurs.

7. A portable utility platform unit according to claim 1 wherein said short depending spaced flange truss clamp member is provided with a short outside depending flange and a short inside depending flange having a space therebetween to conformable receive therewithin a truss member having a 2-inch nominal thickness.

8. A portable utility platform unit according to claim 1 wherein said elongated depending spaced flange truss clamp member is provided with an elongated outside depending flange and an elongated inside depending flange having a space therebetween to conformably receive therewithin a truss member having a 2-inch nominal thickness.

9. A portable utility platform unit according to claim 7 wherein said short inside depending flange is provided upon the truss conforming contact side thereof with a laterally spaced set of longitudinally disposed friction cleats.

10. A portable utility platform unit according to claim 8 wherein said elongated inside depending flange is provided upon the truss conforming contact side thereof with a laterally spaced set of longitudinally disposed friction cleats.

* * * * *